US011019437B2

(12) United States Patent
Kuhn et al.

(10) Patent No.: US 11,019,437 B2
(45) Date of Patent: May 25, 2021

(54) EAR DOME FOR A RECEIVER OF A HEARING DEVICE, METHOD OF MANUFACTURING AN EAR DOME, AND HEARING DEVICE

(71) Applicant: SIVANTOS PTE. LTD., Singapore (SG)

(72) Inventors: Johannes Kuhn, Fuerth/Burgfarnbach (DE); Stefanie Beyfuss, Erlangen (DE); Lars Clad, Nuremberg (DE); Tobias Bayer, Hilpolstein (DE)

(73) Assignee: Sivantos Pte. Ltd., Singapore (SG)

( * ) Notice: Subject to any disclaimer, the term of this patent is extended or adjusted under 35 U.S.C. 154(b) by 62 days.

(21) Appl. No.: 16/525,904

(22) Filed: Jul. 30, 2019

(65) Prior Publication Data

US 2020/0037089 A1 Jan. 30, 2020

(30) Foreign Application Priority Data

Jul. 30, 2018 (DE) ..... 102018212704.2

(51) Int. Cl.
*H04R 1/02* (2006.01)
*H04R 25/00* (2006.01)

(52) U.S. Cl.
CPC ..... *H04R 25/658* (2013.01); *H04R 25/652* (2013.01)

(58) Field of Classification Search
CPC .. H04R 1/1083; H04R 1/1016; H04R 1/1008; H04R 1/1041; H04R 1/105; H04R 1/1066; H04R 25/00
See application file for complete search history.

(56) References Cited

U.S. PATENT DOCUMENTS

2009/0110890 A1* 4/2009 Garza ..... A47L 13/16 428/212
2009/0180653 A1* 7/2009 Sjursen ..... H04R 25/60 381/322
2010/0220464 A1 9/2010 Gruenbacher
2011/0194717 A1 8/2011 Hansen et al.
2014/0205125 A1* 7/2014 Triato ..... H04R 1/1066 381/330

(Continued)

FOREIGN PATENT DOCUMENTS

CN 101400375 A 4/2009
CN 201674641 U 12/2010
CN 204810508 U 11/2015

(Continued)

OTHER PUBLICATIONS

Anonymous: "CROS Pure transmitter Content—User Guide", Feb. 1, 2016 (Feb. 1, 2016), XP055645347, URL:https://www.signia-pro.dk/wp-content/uploads/sites/91/2016/07/Userguide-CROS-Pure-primax-English-2.pdf [found on the Internet Nov. 21, 2019].

*Primary Examiner* — Amir H Etesam
(74) *Attorney, Agent, or Firm* — Laurence A. Greenberg; Werner H. Stemer; Ralph E. Locher

(57) ABSTRACT

A dome for retaining a hearing device or hearing device part in the ear of a user wearing the hearing device. The dome includes, or is composed of, an indicator material that changes perceptibly as a function of a duration of use of the dome. Based on the change in the indicator material, it is possible to ascertain that a recommended maximum duration of use of the dome has been exceeded.

10 Claims, 2 Drawing Sheets

(56) References Cited

U.S. PATENT DOCUMENTS

2015/0000589 A1 1/2015 Nieten et al.

FOREIGN PATENT DOCUMENTS

| | | | |
|---|---|---|---|
| CN | 206272815 | U | 6/2017 |
| CN | 206602626 | U | 10/2017 |
| EP | 2222216 | B1 | 9/2016 |
| WO | 2009058191 | A1 | 5/2009 |
| WO | 2010092193 | A2 | 6/2010 |
| WO | 2018103899 | A1 | 6/2018 |

* cited by examiner

EAR DOME FOR A RECEIVER OF A HEARING DEVICE, METHOD OF MANUFACTURING AN EAR DOME, AND HEARING DEVICE

CROSS-REFERENCE TO RELATED APPLICATION

This application claims the priority, under 35 U.S.C. § 119, of German patent application DE 10 2018 212 704.2, filed Jul. 30, 2018; the prior application is herewith incorporated by reference in its entirety.

BACKGROUND OF THE INVENTION

Field of the Invention

The invention relates to a dome for retaining a hearing device or part of a hearing device inside the ear of a person wearing the hearing device (hereinafter also called the "user"). The invention also relates to a method of using the dome, to a hearing device that comprises the dome, and to the use of an indicator material to manufacture or coat an ear dome.

A hearing device is used to supply a hearing-impaired person with ambient acoustic signals that are processed and in particular amplified so as to compensate for the respective hearing impairment. Such a hearing device usually comprises an input transducer, for example in the form of a microphone, a signal processing unit with an amplifier, and an output transducer. The output transducer is typically implemented as a miniature loudspeaker and is also referred to as a receiver. In particular, the output transducer generates acoustic output signals that are directed to the patient's hearing system and produce the desired hearing perception therein.

In order to meet diverse individual needs, different types of hearing devices are available. In BTE (Behind-The-Ear) hearing devices, a housing, with components such as a battery and the signal processing unit, is worn behind the ear. Depending on the configuration, the receiver may either be arranged directly in the wearer's ear canal (so-called ex-receiver hearing devices or receiver-in-channel (RIC) hearing devices). Alternatively, the receiver is arranged inside the housing itself and a flexible sound tube directs the receiver's acoustic output signals from the housing to the ear canal (tube hearing devices). With ITE (In-the-Ear) hearing devices, a housing that contains all the functional components, including the microphone and receiver, is worn at least partially in the ear canal. CIC (Completely-in-Canal) hearing devices are similar to ITE hearing devices, but are worn completely in the ear canal.

An "instant fit hearing device" is a type of in-the-ear hearing device in which the housing has a standard shape that is not adapted to the individual, and a flexible dome, by means of which the hearing device may be fastened in the ear canal, is attached to the housing.

A flexible dome (also referred to as a retaining cap) is sometimes also used with RIC hearing devices or BTE hearing devices to hold the external receiver or sound tube. In addition to fixing the position, the dome also serves as an acoustic seal in the ear canal.

As is well known, a dome is exposed to such contaminants as cerumen (commonly known as "earwax") or sweat during use. These contaminants may block a sound opening in the dome through which the sound that the hearing device generates is directed into the user's ear. This at least impacts the sound quality. In the worst case, a receiver borne by the dome may be damaged by infiltrating dirt. Because proper cleaning of the dome is not guaranteed for every user, it is recommended to replace an inserted dome with a new dome at regular intervals.

SUMMARY OF THE INVENTION

It is accordingly an object of the invention to provide a dome and a hearing device which overcome the above-mentioned and other disadvantages of the heretofore-known devices and methods of this general type and to provide a dome for retaining a hearing device or part of a hearing device in the ear of a person who wears the hearing device, that is adapted to assist the user in replacing it regularly.

With the foregoing and other objects in view there is provided, in accordance with the invention, a dome for retaining a hearing device or hearing device part in an ear of a user wearing the hearing device, the dome comprising:

- a dome body for placement in the ear of the user;
- an indicator material configured to change perceptibly in dependence on a duration of use of the dome;
- wherein, on a basis of a change in the indicator material, it is possible to ascertain that a recommended maximum duration of use of the dome has been exceeded.

In other words, the objects of the invention are achieved by the claimed dome and the claimed method. The dome, or retaining cap, for retaining a hearing device or part of a hearing device in the ear of a user who wears the hearing device comprises, according to the invention, an indicator material that changes perceptibly as a function of a duration of use of the dome, so the change in the indicator material makes it apparent when a recommended maximum duration of use has been exceeded. In particular, a certain degree of change serves as a criterion that a recommended maximum duration of use of the dome has been reached or exceeded. In other words, a specific change in the indicator material signals the user to replace the dome.

The term "comprises" refers to the fact that in the context of the invention, the dome is made entirely or partially of the time-variant indicator material. In other words, it is equally possible in the context of the invention that the body of the dome consists entirely or partially of the indicator material or that the surface of the dome is entirely or partially furnished with a coating of the indicator material.

In the course of the method according to the invention for using the dome, the dome is first, at the beginning of its duration of use, properly fastened to a hearing device and then properly worn. In the course of use, the indicator material of the dome changes perceptibly. Ultimately, the dome is replaced when the change in the indicator material indicates that a recommended maximum duration of use of the dome has been reached or exceeded.

Because the indicator material signals to the user when the dome is recommended to be replaced, regular replacement of the dome is advantageously ensured to a considerable extent. Thus, a high sound quality of an assigned hearing device is achieved user if the wearer cleans the dome only improperly, irregularly or not at all. The same applies advantageously for protecting a potentially-associated receiver against contamination that could infiltrate the receiver if the dome is insufficiently cleaned.

In a particularly preferred embodiment, the dome comprises an indicator material that degrades, in particular biodegrades, as a function of the duration of use.

In a first variant, the dome is made entirely or partially of the indicator material. In particular, a flexible section of the dome is made of the indicator material. As a result of degradation, after a certain duration of use the indicator material becomes brittle or hard. This change in flexibility serves as a tangible criterion for replacing the dome. Advantageously, in this case, the user is compelled to replace the dome due to the reduced wearing comfort.

Making the dome from a degradable indicator material, in particular a biodegradable/compostable material, is also in itself an advantage for environmental reasons, in view of the immense quantities of plastic waste.

In a second variant, the dome comprises a section covered by a layer of a degradable indicator material that differs in color from that section. The differently-colored layer degrades as a function of the duration of use of the dome, so that the initially-covered section of the dome becomes visible after a certain duration of use. This results in a visible change in the color of the dome or section of the dome, as a function of the duration of use. As soon as the initially-covered section of the dome becomes visible, the dome must be replaced.

In one embodiment, the dome comprises an indicator material that changes color as a function of the duration of use. The term "changes color" here encompasses both a change in the color itself and a change in the intensity of the color. In particular, a complete or almost complete color change, preferably a complete or almost complete fading of the color, serves as a visible criterion for the user to replace the dome.

A hearing device according to the invention comprises a dome as described above.

In particular, the hearing device is a hearing aid that enables users with reduced hearing ability to perceive acoustic signals normally. The scope of the invention also encompasses hearing devices for users with normal hearing, such as headphones that are worn in the ear.

Other features which are considered as characteristic for the invention are set forth in the appended claims.

Although the invention is illustrated and described herein as embodied in an ear dome, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Components that correspond to each other are assigned the same reference signs throughout the drawings.

DETAILED DESCRIPTION OF THE INVENTION

Figure 1:
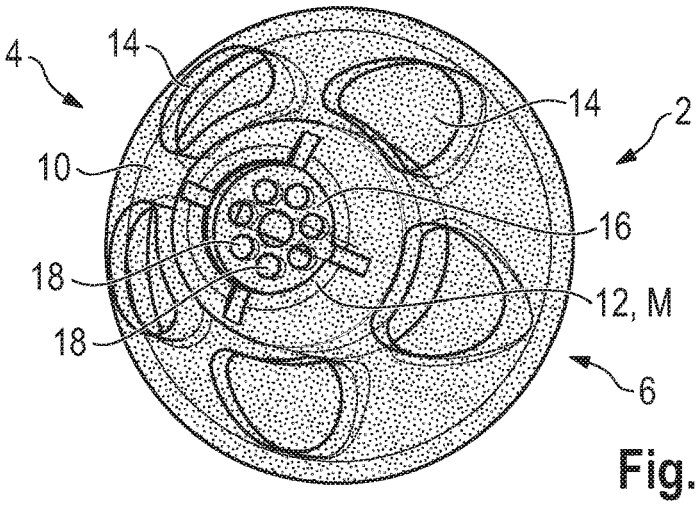
FIG. 1 is a perspective view of a replaceable dome for a hearing device that comprises a cap section and a mounting section for fitting onto the hearing device.

FIG. 1 shows a front side 4 of an ear dome 2, also referred to as a retaining cap 2 according to a first embodiment. The dome 2 is for example attached to an external loudspeaker (receiver) of an RIC hearing device or to the sound tube of a BTE hearing device. The dome 2 is properly inserted into the ear of a user who wears the hearing device, in such a way that the front side 4 faces the user's inner ear, while the rear side 6 of the dome 2, opposite the front side 4, faces the outer ear.

The dome 2 comprises a flexible cap section 10 and a mounting section 12. The flexible cap section 10 abuts the user's ear canal wall when the hearing device is inserted. To this end, the cap section 10 has approximately the shape of a thin-walled cap/mushroom/dome. A plurality of openings 14 are formed throughout the cap section 10 in the axial direction, and as a result, the form flexibility of the cap section 10 is increased.

The mounting section 12 has a mounting hole 16 at the rear that serves to non-positively fasten the dome 2 to the loudspeaker or sound tube. On the front side, the dome 2 has a plurality of sound openings 18 that direct the sound that the hearing device generates towards the user's ear drum. Contaminants such as earwax in particular may clog the sound openings 18.

In the illustrated embodiment, the mounting section 12 is made of a plastic that loses color over time.

In FIG. 1, the dome 2 is shown in an unused state at the beginning of a period of use during which the dome 2 will be used. At this time, the mounting section 12 has a strong color, for example red.

Figure 2:
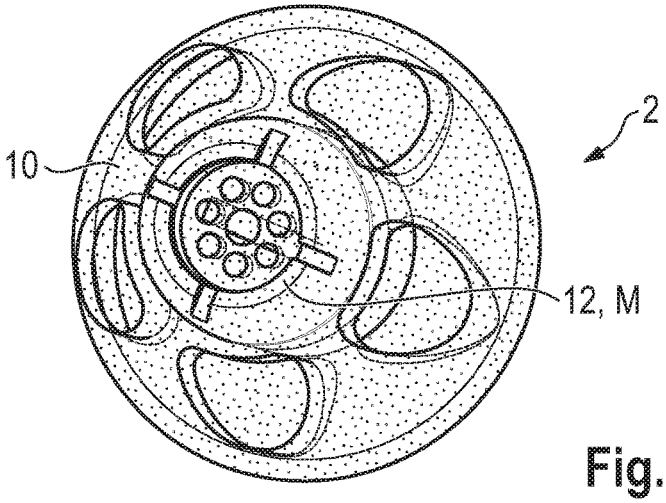
FIG. 2 and FIG. 3 are similar views of the dome wherein the mounting section shows different stages of fading depending on its duration of use.

In FIG. 2 the dome 2 is shown in a state in which it is used during its duration of use. At the point in time that is illustrated in FIG. 2 (after a duration of use of approximately two weeks, for example) the mounting section 12 has a slightly lighter color compared to FIG. 1.

Figure 3:
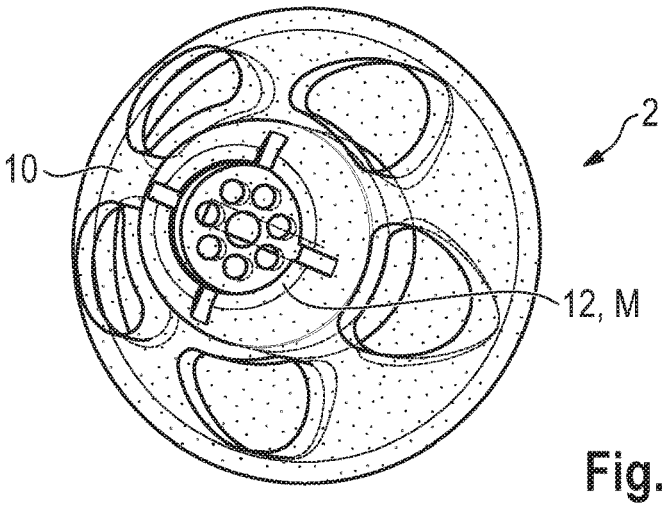

FIG. 3 shows the dome after a duration of use of about four weeks. At this point, the color of the mounting section 12 is completely gone. The complete fading of the mounting section 12 serves as a visible criterion to inform the user that the dome 2 has reached its maximum duration of use (i.e., the maximum recommended wearing time) and should be replaced. Thus, for purposes of the invention, the plastic from which the mounting section 12 is made, or a dye with which the plastic is dyed, serves as the indicator material M.

Thermoplastic polyesters such as polylactide (PLA), polyglycolide (PGA) or copolymers thereof, i.e. a composition of PLA and PGA to form polylactide-co-glycolide (PLGA), are suitable as indicator materials. These are biodegradable polymers that are well suited for use in the ear canal, due to their low bending strength and low water absorption.

During the manufacturing process, the physical and mechanical properties of these polymers are adjusted in such a way that the time required for the indicator material to degrade and thus become faded is altered and, in addition, the material is adapted to the environmental conditions of the inner ear canal.

Pigments are added (during processing) to color the polymer compositions. Iron (III) oxide, for example, is as a suitable pigment to obtain a red color. Alternatively, other mineral pigments (metal oxides) are used to color the indicator material in a wide variety of colors.

Figure 4:
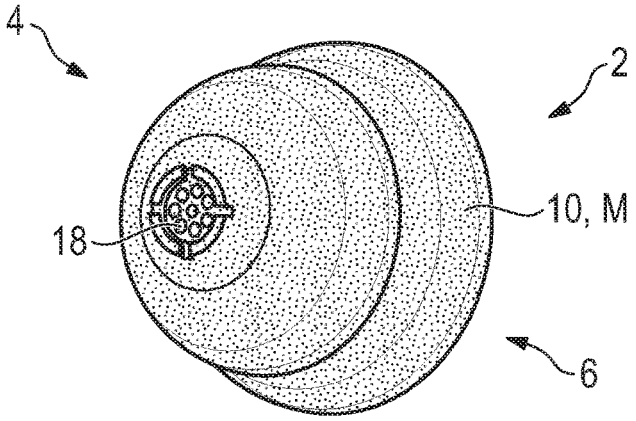
FIG. 4 is a perspective view of an alternative embodiment of the dome according to the invention where the entire cap is subject to fading.

FIG. 4 shows an alternative embodiment of the dome 2. In contrast with the first embodiment, the cap section 10 here is bell-shaped and has no openings. Furthermore, in contrast with the first embodiment, the entire dome 2 (i.e. both the cap section 10 and the mounting section 12) is made of an indicator material M that changes its color as a function of the duration of use.

Figure 5:
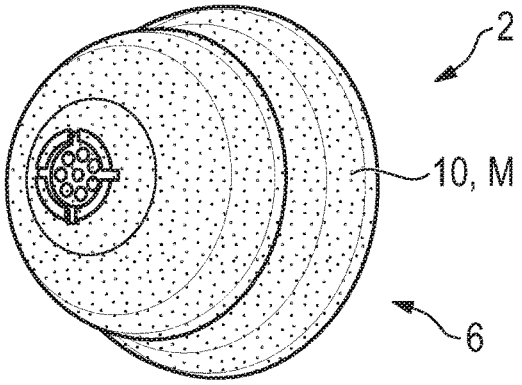
FIG. 5 and FIG. 6 are similar views showing the entire dome differently faded depending on its duration of use.
Figure 6:
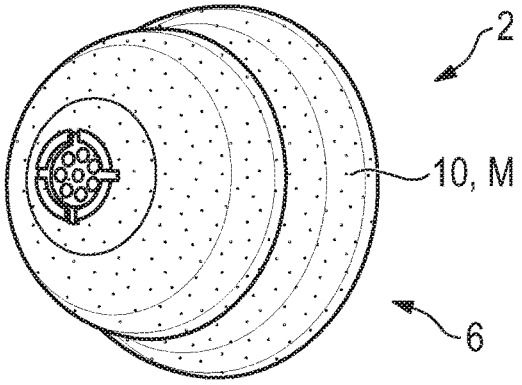

As shown in FIG. 4, at the beginning of its duration of use, the dome 2 has a strong red color. As shown in FIG. 5, the color of the dome 2 is visibly reduced after an approximately two-week duration of wear. As shown in FIG. 6, the color of the dome 2 is completely removed, which induces the user to dispose of dome 2 and replace it with a new one.

Preferably, a biodegradable indicator material such as the aforementioned PLA, PGA or PLGA thermoplastic polyesters for the dome 2 (independently of the specific embodiment) is used, so that the material may be composted after disposal without environmental contamination.

The invention is particularly clear in the exemplary embodiments described above, but is not limited to these exemplary embodiments. Rather, additional embodiments of the invention may be derived from the claims and the above description.

The following is a summary list of reference numerals and the corresponding structure used in the above description of the invention:

2 Dome
4 Front
6 Rear
10 Cap section
12 Mounting section
14 Opening
16 Fastening opening
18 Sound opening
M Indicator material

The invention claimed is:

1. A dome for retaining a hearing device or hearing device part in an ear of a user wearing the hearing device, the dome comprising:

a dome body for placement in the ear of the user;

an indicator material configured to change perceptibly in dependence on a duration of use of the dome;

wherein, on a basis of a change in the indicator material, it is possible to ascertain that a recommended maximum duration of use of the dome has been exceeded.

2. The dome according to claim 1, wherein said indicator material is configured to degrade as a function of the duration of use.

3. The dome according to claim 2, wherein said indicator material is a biodegradable material.

4. The dome according to claim 2, wherein said dome body is entirely or partially made of said indicator material.

5. The dome according to claim 2, wherein indicator material is a coating on said dome body.

6. The dome according to claim 2, wherein:

a section of said dome body is covered by a layer of a degradable indicator material that differs in color from said section; and said layer degrades as a function of the duration of use, and thereby visibly exposes the initially-covered said section of the dome.

7. The dome according to claim 1, wherein said indicator material changes a color as a function of the duration of use.

8. A method of using a dome, the method comprising:

providing the dome according to claim 1;

fastening the dome to a hearing device and beginning a duration of use;

wherein the indicator material of the dome successively undergoes perceptible changes; and replacing the dome when a change in the indicator material indicates that a recommended maximum duration of use of the dome has been exceeded.

9. A hearing device, comprising a dome according to claim 1.

10. A method of manufacturing a dome for retaining a hearing device in an ear of a user wearing the device, the method comprising:

providing an indicator material and manufacturing the dome with the indicator material;

wherein in indicator material changes perceptibly as a function of a duration of use of the dome; and wherein the indicator material enables an ascertainment that a recommended maximum duration of use of the dome has been exceeded.

* * * * *